United States Patent [19]

Fournier

[11] Patent Number: 4,589,618

[45] Date of Patent: May 20, 1986

[54] HOLDING DEVICE FOR A TUBE BUNDLE

[75] Inventor: Yves Fournier, Chatenoy le Royal, France

[73] Assignee: Creusot-Loire, Paris, France

[21] Appl. No.: 435,599

[22] Filed: Oct. 21, 1982

[30] Foreign Application Priority Data

Oct. 23, 1981 [FR] France ..... 81 19980

[51] Int. Cl.[4] ..... F16L 3/22

[52] U.S. Cl. ..... 248/68.1; 165/162

[58] Field of Search ..... 248/68.1, 65, 74.1, 248/74.5; 165/162

[56] References Cited

U.S. PATENT DOCUMENTS

| | | | |
|---|---|---|---|
| 1,262,763 | 4/1918 | Farley | 248/68.1 X |
| 1,315,225 | 9/1919 | Hughes | 248/68.1 |
| 3,045,981 | 7/1962 | Hendrickson | 165/162 X |
| 3,385,545 | 5/1968 | Patton | 248/68.1 |
| 3,526,934 | 9/1970 | Owen | 248/68.1 X |
| 4,359,088 | 11/1982 | Jabsen | 165/162 X |

*Primary Examiner*—Ramon S. Britts
*Assistant Examiner*—David M. Purol
*Attorney, Agent, or Firm*—Pollock, Vande Sande & Priddy

[57] ABSTRACT

A holding device for a tube bundle, constituted by undulated metal strips, each row of tubes receiving at least one set of two metal strips extending transversely to the tubes, on each side of the row of tubes. The metal strips are incurved in the direction of the tubes at the level of each tube and are incurved in the other direction at the level of each gap separating the tubes, the strips situated on each side of the same tubes thus being brought towards each other. Between the tubes, slightly spaced clamping elements are provided for exerting a force clamping the strips towards one another, at the level of the zone situated between the tubes, so as to apply the strips on each side of the tubes with a pre-determined force, at the level of the incurved zones in the direction of the tubes. The invention is particularly applicable to steam generators.

4 Claims, 7 Drawing Figures

Fig 4
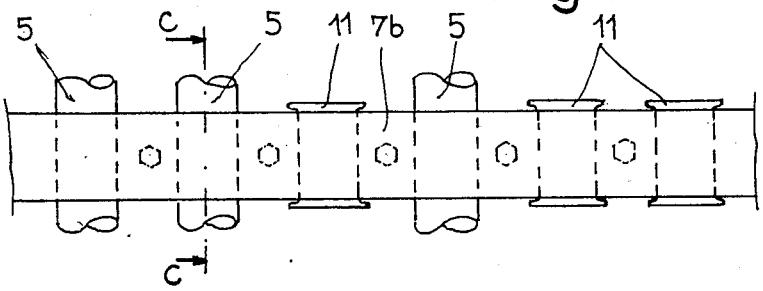
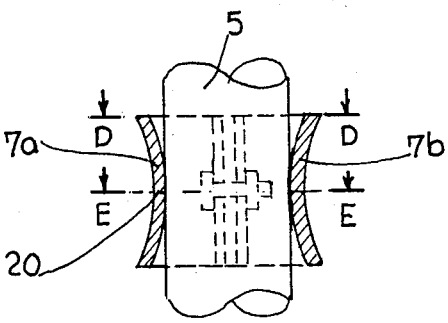
Fig 5
Fig 6
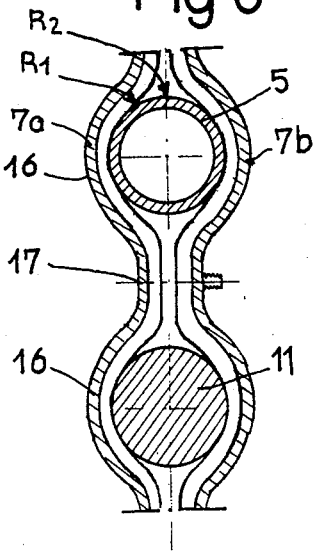
Fig 7
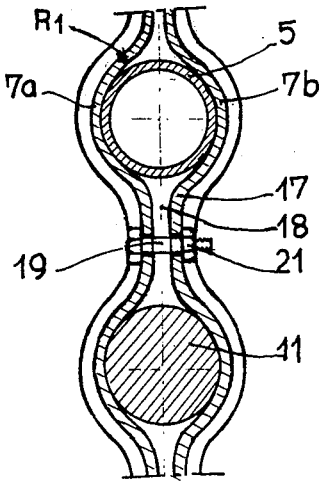

HOLDING DEVICE FOR A TUBE BUNDLE

FIELD OF THE INVENTION

The present invention relates to a device for holding in position a set of tubes forming a bundle while limiting the possibility of vibrations of these tubes as far as possible. The device may be applied particularly to the support of a tube bundle constituting the water-steam circuit of a steam generator of the sodium-water type which is used particularly in nuclear power stations of the fast breeder type.

The invention also relates to a method of assembling such a device.

BACKGROUND OF THE INVENTION

In heat exchangers one of the circuits of which is constituted by a bundle of tubes, difficulties are encountered at present in the positioning and the holding in place of these tubes. One difficulty resides in the fact that very often there exist differential expansions between the tubes which prohibits any absolutely rigid fastening at various points of the tubes. Another difficulty resides in the fact that, because the tubes are in a high speed fluid flow, vibration phenomena result in them, and it is then necessary to provide supports which damp these vibrations and which are distributed so that the free sections of the tubes do not exhibit a frequency of their own close to the frequency of the vibrations.

Such a problem of fastening a tube bundle is particularly important and delicate in the case of a speed generator of the sodium-water type in which the water-steam circuit is constituted by a tube bundle extending inside a vessel in which hot liquid sodium circulates. The essential difficulty inherent in the steam generator of the sodium-water type arises from the fact that liquid sodium possesses excellent thermal conductivity, a property which is of considerable value but which inflicts on the tube bundle violent temperature variations in transient operation, resulting in considerable differential expansions in these tubes.

Various support devices for the tube bundle have already been proposed, but these have certain drawbacks, especially relatively high complexity, risk of distortion or of wear of the tubes at the level of their clamping by the support, lack of control of the level of internal stresses developing in the tubes, due to the fact of their differential expansions, and a lack of constancy in time of the fastening and anti-vibration characteristics.

SUMMARY OF THE INVENTION

It is an object of the invention to provide a device which ensures the support of tubes with elasticity by means of metal strips. It is another object of the invention to provide a device wherein the dimensions and shapes of the strips procure a point contact on the tubes which permits movements (rotations and axial slidings) of these tubes in the course of operation.

It is a further object of the invention to provide a device whose arrangement contributes to moving the strips away from a frequency at which the tubes could be energized to a common mode.

It is another object of the invention to provide a device wherein the flow of fluid around the tubes can still take place easily.

It is a further object to provide a device wherein the elasticity of the strips enables deviations in position at the time of assembly to be acceptable.

According to the invention, there is provided a support device for a tube bundle housed in a vessel wherein a fluid circulates around these tubes arranged in rows, said device comprising at least one pair of metal strips each having undulations adapted to receive the tubes, the undulations of two strips arranged on each side of a row being situated facing one another so that the tubes are gripped under the effect of the clamping elements arranged between said undulations and clamping said strips towards one another the ends of the strips being joined to one another and to the fixed parts of the vessel.

According to one feature, each strip has at the level of each undulation in contact with the tube a slight curvature in the transverse direction, so that the lateral portions of the strips are spaced from the tube and only the central portion of the strip is in contact with the latter.

According to another feature, the radius of the undulation in contact with the tube is greater than the radius of the tube.

According to another feature of the invention, the metal strips are of steel with high yield strength.

Other features and advantages of the invention will be apparent from the following description of a preferred embodiment, illustrated by the accompanying drawings, which are not to be taken as in any way limiting.

BRIEF DESCRIPTION OF THE DRAWINGS

In the drawings.

FIG. 4 is an enlarged view of a support device adapted for a steam generator as in FIG. 1.

FIG. 5 is a section along the line C—C of FIG. 4.

FIG. 6 is a section along the line D—D of FIG. 5.

FIG. 7 is a section along the line E—E of FIG. 5.

DETAILED DESCRIPTION

The embodiment described has been taken from the field of steam generators of the sodium-water type used in a nuclear power station of the fast breeder type.

Figure 1:
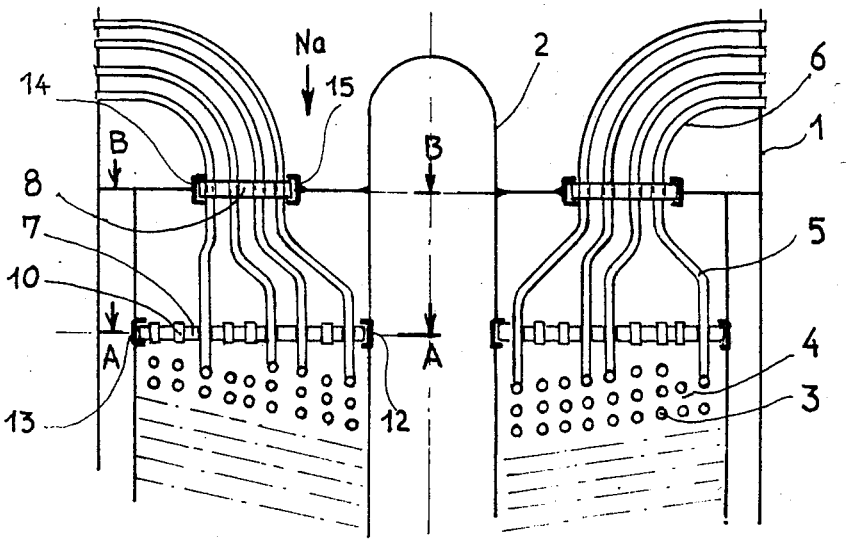
FIG. 1 is a simplified view in longitudinal section of the upper portion of the tubular bundle of a steam generator.

FIG. 1 shows the upper part of a structure or vessel of a steam generator which is constituted essentially by an outer vertical cylindrical jacket 1 and a central cylindrical tube 2 forming between them an annular space.

Tubes 3 are housed in this annular space separating the tube 2 and the jacket 1. Hot liquid sodium flows in the annular space comprised between the jacket 1 and the tube 2 which confine the sodium flow. This flow is parallel to the axis of the cylinders 1 and 2 and proceeds from below upwards. The sodium yields up its heat in passage to pressurized water which flows in the tubes 3 and which is then converted into steam.

The tubes 3 are arranged, wound in this manner in the greater part of the steam generator, and their lower and upper ends open in known manner outside of the jacket 1 FIG. 1 shows the coupling with the outside.

In FIG. 1 is seen the coupling with the outside of the upper end of the tubes 3. After the end of the wound zone 4 of the tubes 3 constituting the tube bundle proper, these tubes are arranged longitudinally in their portion 5, then assembled and bent again in the form of lyres in their front portion 6 before traversing the jacket 1 and extending outside the jacket 1 whence they are collected in known manner (not shown). The whole of the longitudinal part 5 of the tubes will be called below, the tube bundle and the curved portion 6 of the tubes will be called below, the lyres.

In the steam generator which has been taken for an illustrated embodiment, the tubes, after having terminated their winding phase 4, are bent again so as to form the portion 5 extending longitudinally and all situated along regularly distributed radii 9*a* and 9*b* in the steam generator.

Figure 2:
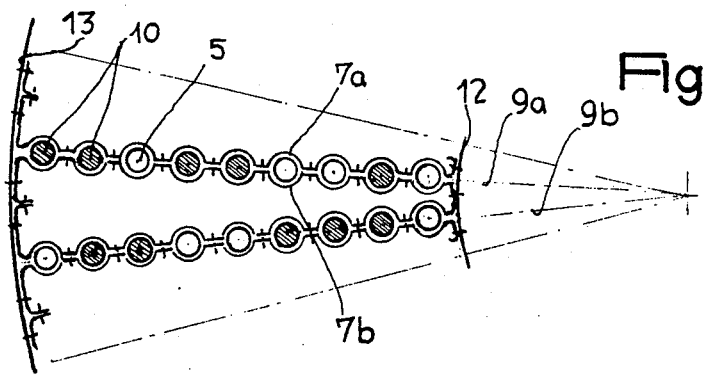
FIG. 2 is a partial section along the line A—A of FIG. 1, at the level of a support device.
Figure 3:
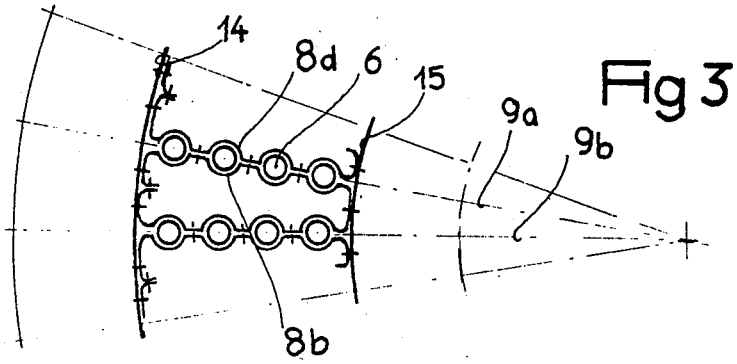
FIG. 3 is a partial section along the line B—B of FIG. 1, at the level of another support device.

The invention relates particularly to devices 7 and 8 serving for the support and the damping of the vibrations of the ends of the tubes 3. The device 7 is arranged at the level of the longitudinal parts of the tubes 5 and the device 8 spaced further from the bundle is arranged close to the lyres 6. FIG. 2 shows, in plan view, the support device of the bundle, and FIG. 3 shows, also in plan view, the support device of the lyres. It will be noted that the support devices of these two types are constructed in quite similar manner.

Each device comprises sheet metal strips of constant thickness 7*a*, 7*b*, 8*a*, 8*b*, which each form undulations 16 adapted to the tubes and between which the zones 17 (FIG. 6) extend. The strips extend transversely to the tubes 5 and perpendicularly to the sodium flow and they are mounted in pairs on each side of each row 9*a*, 9*b* of tubes 5 so as to grip the tubes as in a collar and hold them in position.

To describe the shape of the metal strips 7 or 8 in more detail, reference will now be made to FIGS. 5, 6 and 7. FIGS. 6 and 7 shows that the undulated metal strips 7*a*, 7*b* are incurved in forming the undulation 16 at the level of each tube. The two strips associated with the same row of tubes form housings within which the tubes pass. The strips are incurved in the zones 17 extending between the waves and corresponding to the gaps separating the tube. FIG. 7 shows the zone 17 of the strips 7*a* and 7*b* at which they are brought closest together so as to form a relatively small space 18. In each of these zones 17 are formed orifices through which bolts 19, 21 pass intended to bring together the metal strips 7*a* and 7*b* in order to cause, at the level of the zone 16 of these metal strips, a gripping of the tubes and thus maintenance in position of the set of tubes, permitting however a certain elasticity in the assembly as well as a certain longitudinal sliding of the tubes due to differential expansions and certain damping of vibrations in the whole of the tube bundle.

Each metal strip is applied against the tubes on one side only. In this way two adjacent metal strips applied against the tubes of two adjacent rows are separated and form a space for the flow of the sodium.

The ends of the two strips 7*a*, 7*b* mounted on each side of a same row of tubes are joined to one another. In addition, the ends of the strips associated with the different rows are joined to one another. To this end, the ends of the strips are fixed by known means to circular parts 12, 13, 14, 15 which are fast to the components 1 and 2 of the vessel.

The clamping force of the tubes must be sufficiently strong to be effective, without however causing caulking or notching of these tubes. For this purpose, the metal strips are given, at the level of the clamping zones 16, a slight curvature in the transverse direction, as shown in FIG. 5, so that the lateral portions of these strips are slightly spaced from the strips with which the tube come into contact, and only the central portion 20 of the strip is in contact with the tube. It is, besides, preferable to provide for the incurved zones 16 of the metal strip, a radius of curvature R1 slightly greater than the radius R2 of the tube 5 or of the part 11 in order that the assembly of the metal strips on to the tubes may allow slight variations in the distances separating the tubes, without creating abnormal stresses in the latter.

All the details of the shape of the strips 7*a* and 7*b* described above are applicable to the metal strips 8*a*, 8*b* which form the support device for the lyres 6.

The tube portions 5 do not occupy the whole of the possible emplacements on the various radii 9*a*, 9*b* etc. This is of course only connected with the type of construction of this steam generator which has been taken as an illustrated embodiment FIGS. 1 and 3 show emplacements 10 which are not occupied by one of the sections 5 of the tubes. Since the distribution of the tubes 5 on a radius 9 is different for all these radii, instead of constituting different support metal sheets adapted to each of the rows of tubes placed on the different radii 9*a*, 9*b* etc., the metal strips have all been constructed identically, of undulated shape and the emplacements 10 devoid of tubes are occupied by cylindrical parts of diameter equal to that of the tubes. In FIG. 4, which is a lateral enlarged view of FIG. 2, are seen such cylindrical parts 11 designed to replace the missing tubes 5.

Since in this embodiment all the tubes arranged on the same radius 9*a*, 9*b*, etc. are then assembled equidistantly to form the lyre 6, at the level of the support device of the lyre 6 which is shown in FIG. 3, there are no longer tubes missing, and consequently there is no need to place cylindrical parts 11. The undulated metal strips 8*a*, 8*b*, etc. are for this reason quite similar to the metal strips 7*a* and 7*b*. They are simply shorter.

It is desirable that this clamping force on the tubes should remain constant over time. In the case of a sodium-water steam generator, which must operate for several decades, and which is subject to a temperature in the vicinity of 525° C., as well as to considerable thermal shocks, the choice of the material composing the metal strips becomes important. The present invention resolves this problem by the choice of a steel with a high hot yield strength as the material composing the metal strips which is steel with a high hot yield strength. A suitable steel is a precipitation hardened austenitic alloy steel preferably comprising titanium and aluminum. Such a steel is quite adapted to the use which is here made thereof in a steam generator of the sodium-water type because it comprises at the same time a high elastic limit comparable with that of a hardened steel and a high elastic tensile modulus or considerable ductility which is characteristic of stainless steels. It can, consequently preserve at 525° C., and even above, high elastic stress with practically no creep, even after a relatively long time.

The invention also relates to the method of mounting the anti-vibration or its support device previously described. It is in fact important that the clamping force of the tubes which is established at the levels of zones 20 of the metal strips have a substantially constant value for all the tubes. This clamping force is produced by the screwing of the bolts 19. Consequently, the method of assembly characteristic of the invention consists of arranging the metal strips *7a* and *7b*, or *8a* and *8b*, on each side of the tubes, installing each of bolts 19 by screwing its nut 21 with a minimum torque so that the rotation of the nut is interrupted as soon as the metal strips start to exert a clamping force on the neighboring tubes, then continuing to screw the nut 21 on to the bolt 19 through a predetermined constant angle of rotation, so as to create in the strips, between each tube, a predetermined constant yield, and consequently to create a clamping force on the tube itself which is relatively constant and predetermined, then finally to immobilize the nut 21 on the bolt 19 by any suitable means, for example, by caulking, pinning, or a spot weld.

I claim:

1. In a vessel within which a fluid flows around tubes in a bundle, arranged in rows, the combination of said tubes with a holding device comprising (a) on opposite sides of each of said rows, at least one pair of metal strips each having undulations forming spaces for receiving said tubes, the undulations of the two strips arranged on opposite sides of a said row facing each other;

(b) clamping means arranged between said undulations for clamping opposite strips toward each other with said tubes gripped therebetween;

(c) the ends of said strips being joined to fixed portions of said vessel;

(d) each of said strips having, at the level of each of said undulations in contact with a said tube, in the transverse direction, a curvature greater than the curvature of said tube; and (e) each of said strips having a slight continuous curvature in a transverse direction, so that each said strip and the corresponding tube are in contact in a quasi-punctual zone.

2. The combination according to claim 1, wherein said undulated metal strips are formed of steel with a high yield strength.

3. The combination according to claim 2, wherein said steel is an austenitic steel with structural hardening.

4. The combination according to any one of claims 1 to 3, wherein, for each undulated metal strip, all the undulations of a said strip incurved in the direction of said tubes come into contact with a said tube emplaced in a said space replacement part having a diameter equal to that of said tubes.

* * * * *